US008985555B2

(12) United States Patent
Cryer et al.

(10) Patent No.: US 8,985,555 B2
(45) Date of Patent: Mar. 24, 2015

(54) DRIVE ASSEMBLY AND APPARATUS FOR HOIST

(75) Inventors: Robert D. Cryer, Erie, PA (US); Allen Randolph, Erie, PA (US); Donald Brian Cooper, Houston, TX (US); George J. Wnukoski, Lawrence Park, PA (US); Mark L. Cooksey, Lawrence Park, PA (US); Ernesto Camilo Rivera, Erie, PA (US)

(73) Assignee: General Electric Company, Schenectady, NY (US)

( * ) Notice: Subject to any disclaimer, the term of this patent is extended or adjusted under 35 U.S.C. 154(b) by 76 days.

(21) Appl. No.: 13/254,334

(22) PCT Filed: Mar. 1, 2010

(86) PCT No.: PCT/US2010/025774

§ 371 (c)(1), (2), (4) Date: Sep. 1, 2011

(87) PCT Pub. No.: WO2010/101832

PCT Pub. Date: Sep. 10, 2010

(65) Prior Publication Data

US 2011/0303886 A1 Dec. 15, 2011

Related U.S. Application Data

(60) Provisional application No. 61/156,580, filed on Mar. 2, 2009.

(51) Int. Cl.
*B66D 1/14* (2006.01)
*B66D 1/22* (2006.01)

(52) U.S. Cl.
CPC ..... *B66D 1/22* (2013.01)
USPC ..... 254/340; 254/344; 254/339; 254/290; 254/295

(58) Field of Classification Search
USPC ..... 254/264, 266, 339, 340, 278, 294, 295, 254/297, 342, 344, 389, 417
See application file for complete search history.

(56) References Cited

U.S. PATENT DOCUMENTS 3,381,939 A * 5/1968 Brown et al. ..... 254/274
3,745,434 A * 7/1973 Lambert et al. ..... 318/139

(Continued)

FOREIGN PATENT DOCUMENTS

CN 2175215 Y 8/1994
CN 2314022 Y 4/1999

(Continued)

OTHER PUBLICATIONS

International Search Report in connection with PCT Application US10/25774 filed Mar. 1, 2010, issued on Jan. 4, 2011.

(Continued)

*Primary Examiner* — Emmanuel M Marcelo
*Assistant Examiner* — Angela Caligiuri
(74) *Attorney, Agent, or Firm* — GE Global Patent Operation; John A. Kramer

(57) ABSTRACT

An assembly includes a motor; a second motor; a planetary transmission coupled to the motor and the second motor, and a spool coupled to the transmission. The spool has an interior volume for receiving the motor, the second motor and the transmission, and the motor and the second motor are disposed or disposable entirely within the spool. The motor and the second motor are capable of being operated such that one of the motors is speed controlled, and the other motor is torque controlled.

18 Claims, 2 Drawing Sheets

(56) References Cited

U.S. PATENT DOCUMENTS

| | | | | |
|---|---|---|---|---|
| 6,126,143 | A * | 10/2000 | Fukunaga et al. | 254/344 |
| 6,163,097 | A | 12/2000 | Smith et al. | |
| 6,766,884 | B2 * | 7/2004 | Parsons et al. | 188/71.5 |
| 6,793,203 | B2 | 9/2004 | Heinrichs et al. | |
| 2007/0181093 | A1 | 8/2007 | De Prato | |
| 2008/0054237 | A1 * | 3/2008 | Rotzler et al. | 254/266 |

FOREIGN PATENT DOCUMENTS

| | | | |
|---|---|---|---|
| CN | 2494819 | Y | 6/2002 |
| CN | 1406203 | A | 3/2003 |
| CN | 201136754 | Y | 10/2008 |
| CN | 101357744 | A | 2/2009 |
| GB | 1360956 | | 7/1974 |
| GB | 1431759 | A | 4/1976 |
| GB | 2129397 | A | 5/1984 |
| SU | 357149 | A1 | 10/1972 |
| WO | 2006005774 | A1 | 1/2006 |
| WO | WO 2008068445 | A1 * | 6/2008 |

OTHER PUBLICATIONS

Russian Office Action issued in connection with corresponding RU Application No. 2011136178 on Jan. 31, 2014.

Unofficial English translation of Office Action issued in connection with corresponding CN Application No. 201080010809.2 on Mar. 5, 2013.

Office Action issued in connection with corresponding CA Application No. 2,753,674 on May 27, 2013.

* cited by examiner

DRIVE ASSEMBLY AND APPARATUS FOR HOIST

For the United States of America, this application is a National Stage of International Application No. PCT/US2010/025774, filed Mar. 1, 2010, which claims the benefit of U.S. Provisional Application No. 61/156,580, filed Mar. 2, 2009.

BACKGROUND

1. Technical Field

Embodiments of the invention may relate to an electrically powered assembly or apparatus. The assembly or apparatus may be used to lift or hoist objects, or otherwise impart tension to a cable secured to a spool.

2. Discussion of Art

Hoists can be used to lift loads. 1-foists can be used in such applications as an anchor handling winch, crane-motion control reel, and cable layer. Another type of hoist that may be used in the oil and gas industry is a drawworks. The wellbore drawworks is an assembly used on a rig or with an oil derrick to raise, lower or hold equipment above, into and/or out of a wellbore. A traveling block can be secured to a crown block at the top of the rig or derrick. The hoist cable or line operates the traveling block, with a dead line secured to the rig floor or ground, and with the other end secured to the drawworks proper and forming a fast line.

The drawworks itself can include a rotatable cylindrical drum or spool upon which the cable or fast line can be wound or coiled (or unwound or uncoiled) by a power assembly that includes a motor. A dry brake can apply a counter force to the motor torque. The motor, or sometimes a plurality of motors, are mechanically coupled to the drum through a gearbox or transmission, using one or more belts, chains, or geared assemblies. The motor(s) and gearbox are fixed to a stationary structure adjacent to the drum. Because of the relatively high horsepower requirements, each of the plurality of motors is mechanically coupled to an aggregator gearbox, and the gearbox provides torque to the drum. Common methods of transmitting mechanical power include belts and chains, as well as countershaft gearing and transmission.

Each of the components that are core to the drawworks (motor, gearbox, and spool) are produced independently and assembled as the drawworks. As new technology in the component is introduced, such as a new motor or brake, the drawworks assembler can upgrade the drawworks assembly. However, innovation is directed to component enhancements, and system level innovation can be problematic.

Other industries include handling cable, lines and chains outside of the oil and gas industry. It may be desirable to have an assembly or apparatus for use hoisting or lifting, or otherwise handling cable, that structurally and/or functionally differs from those that are currently available.

BRIEF DESCRIPTION

In one embodiment, an assembly is provided that includes a motor; a planetary transmission coupled to the motor; and a spool coupled to the transmission and has an interior volume for receiving the motor and the transmission, and the motor and transmission are disposed or disposable only partially within the spool and partially outside of the spool.

Implementations of the invention may include an electro-mechanical drive module that can be used as a component of a hoist, winch, or drawworks apparatus. The electro-mechanical drive module includes a motor; a transmission coupled to the motor; and a spool coupled to the transmission such that the resulting electro-mechanical drive module satisfies one or more of the following criteria: the electro-mechanical drive module rotates and/or reacts relative to itself, and requires mounting only to a single fixed and/or stationary reference; the electro-mechanical drive module creates a single reactionary moment or couple during use; or the transmission fully supports the spool without intervening couplings capable of transferring mechanical energy.

DETAILED DESCRIPTION

Figure 1:
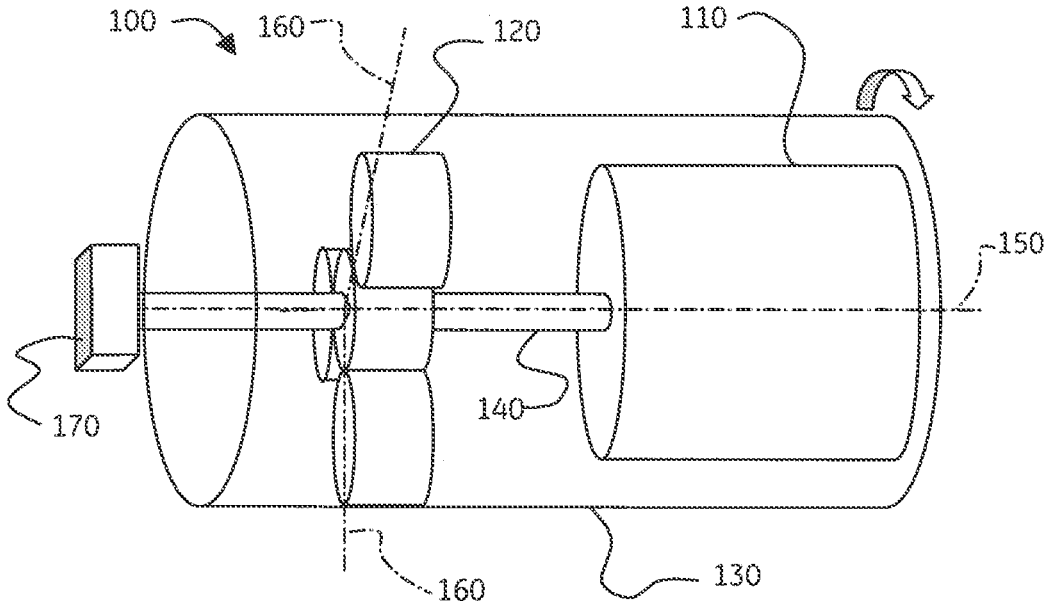
FIG. 1 is a schematic diagram of an assembly that includes one or more embodiments of the invention.

An embodiment of the invention relates to a powered spool that can take up and pay out a line, which coils around the spool when the line is taken up. Embodiments of the invention relate to an electrically powered assembly or apparatus. Embodiments of the invention may relate to a method of making or using the assembly or apparatus.

As used herein, a motor is an electric motor, which uses electrical energy to produce mechanical work via rotation. The motor may be used as a generator or dynamo in the instance where mechanical work via rotation is the input, and electrical energy is the output. A transmission is an apparatus that can transfer mechanical force from one component to another component, and which may result in rotational output speeds that differ from the rotational speed of the input. A gearbox is a type of transmission. A spool, sometimes referred to as a drum, is a generally cylindrical structure about which a line may be coiled. A line may be a cable (mechanical/tension, optical or electrical), a wire, a cord, a chain, or a filament. A drawworks includes oil-well drilling mechanisms used to supply lifting and driving power to a drill motor, and which may be capable of hoisting the weight of a plurality of drilling segments and the drill motor that drives the segments.

According to one embodiment, an assembly is provided that includes a motor; a planetary transmission coupled to the motor; and a spool coupled to the transmission. An optional controller may communicate and actuate the motor. The motor may be an electric motor selected based on such criteria as available forms of electricity, application performance demands, desired efficiency levels, cooling method, cooling media, and the like. Based on an evaluation of such application specific parameters, a suitable motor may be an alternating current (AC) motor, or a direct current (DC) motor. Commercially available motors may be selected, as appropriate, from such suppliers as General Electric Company (Fairfield, Conn.). For an AC motor, the GDY106 and GDY108 models may be useful examples of suitable motors. For a DC motor, the GEB23 or GEB25 models may be useful examples of suitable motors.

The specifications of the motor may influence the motor selection. Suitable motors may have a horsepower rating of greater than 1000 horsepower (HP), 1500 HP, 3000 HP or 6000 HP. The motor may be disposed or disposable at least partially within the spool. Accordingly, for this embodiment the volume defined by the inner surface of the spool is a limiting factor in motor selection. Sometimes, the more horsepower a motor is rated to have, the larger is the motor. If, then, the drum size is constrained by application specific parameters, and the motor size is constrained the drum size, then the motor selection and configuration must account for the balanced needs of horsepower and drum size. In one embodiment, the motor is disposed or disposable entirely within the spool. Further, the transmission may be also disposed, partially or entirely, within the spool with the motor.

Based on such factors as efficiency, economy, performance, reliability and the capacity to free wheel, the selection of the motor may include a permanent magnet motor. In another embodiment, the motor is not a permanent magnet motor. Other suitable motors may include an AC/induction motor or a switched-reluctance motor.

During use, there may be sometimes a need for thermal management of the assembly. An optional cooling system may be in thermal communication with the motor and/or transmission. The motor may be enclosed and coupled to a cooling fan. The thermal management or cooling system may include a water-to-air cooling system. The motor may be a water-cooled motor. The motor may be coupled to a drip-proof motor cooling system. The motor may be coupled to a blower ventilation system.

A suitable motor may have a power to weight ratio of greater than 0.182 horsepower per pound (HP/lb). In one embodiment, the power to weight ratio may be in a range of from about 0.18 HP/lb to about 0.19 HP/lb.

With regard to the transmission, a suitable transmission may include a gearbox. Gears of the transmission may have thrust angles that are symmetric relative to each other. The planetary transmission may include a sun gear that is coupled to a common shaft. In one embodiment, two or more of the motor, the sun gear, and the spool are co-linear with the shaft. The transmission may include a ring gear. The transmission may be directly coupled to the motor without additional intervening mechanical couplings or joints. Mechanical couplings or joints may be points of wear or of failure, and may require monitoring and/or lubrication. Accordingly, reduction or elimination of mechanical couplings or joints may positively affect life and performance. The transmission may be directly coupled to the drum without intervening mechanical couplings or joints.

Suitable transmissions may have a torque or power density of greater 4.5 million Newton-meters per cubic meter, or 100 HP per liter. The transmission may be disposed or disposable at least partially within the spool, or may be configured to be disposed or disposable entirely within the spool. In one embodiment, the assembly is entirely devoid of countershaft gearboxes.

With regard to the spool, coupled to the inner surface of the spool may be one or more of a pinion, planet, or ring bearings. Additionally or alternatively, the spool may include an internal helical gear. The spool can support a length of line coiled around the outer surface of the spool. During operation of the assembly, the spool can rotate and thereby can pay out and take in a length of the line in response to rotation of the spool about an axis.

The spool dimensions can be selected based on application specific parameters. Such parameters include the type of line, the intended end use, the length of line needed, and the available real estate, space, volume, or footprint into which the assembly must be configured. A suitable spool may have a diameter that is in a range of from about 60 centimeters about 140 centimeters. A suitable volume for the spool may be in a range of from about 60 liters to about 300 liters.

If portions, or all, of the assembly components (other than the spool) fit within the spool, then the whole assembly may have width and length dimensions that are in a range of from about 3 meters by 4.5 meters to about 4 meters by 9.5 meters. The selection of materials and components, naturally, must fit also the needs of the end use application.

In one embodiment, a common shaft may be operatively coupled to the motor and to the transmission. A suitable shaft may be a monolithic single piece. However, other suitable shafts may include two or more segments. If the shaft includes segments, the segments can be secured to each other via a spline, a friction fitting, a compression fitting, a taper and hub, a key, a universal joint, or a shrink fit. The selection of the fastener may be based on application specific parameters, as these fastener mechanisms are not readily interchangeable.

Optionally, a second motor may be coupled to the transmission. Alternatively, the second motor may be coupled to the spool via a second transmission. Suitable second motors may be of the types of suitable motors described hereinabove. However, the second motor is not required to be the same as the first or other motor. In addition to the first referenced motor, the second motor may be disposed or disposable at least partially, or entirely, within the spool.

Where there are two or more motors in an assembly, the motor and another motor may be operated such that one of the motors is speed controlled, and another motor is torque controlled. The controller may be responsive to sensors and feedback from the motors, and the control system may be a closed loop control system.

A brake system may be coupled to the spool. If there is a common shaft coupled to the transmission, the common shaft can be coupled to the brake system. Suitable brake systems include a dry brake system, where the dry brake system is a disk brake system; and a wet brake system, where the wet brake system is a hydraulic brake system.

A lubrication system may be in operative communication with the transmission. Lubrication is the process employed to reduce wear of one or both surfaces that are in close proximity and are moving relative to each another by interposing a substance called lubricant between the surfaces to carry or to help carry the load (pressure generated) between the opposing surfaces. The interposed lubricant film can be a solid, (e.g., graphite, $MoS_2$), a liquid (oil), or a liquid-liquid dispersion (grease). In one embodiment, the transmission rotates the spool during use, and the spool rotation causes the lubricant to flow and to contact the transmission. The gear housing itself, then, is the housing for the lubrication system.

Optionally, a sensor system is provided with the assembly. The sensor system senses one or more parameter selected from temperature, torque, pressure, speed, location, lubricity/lubrication quality, lubricant metal content, electromagnetic interference (EMI) profile, vibration, water content, or pressure. The sensor system communicates the sensed parameter, or information indicative thereof, to the controller or control unit. The control unit can be proximate the assembly. In one embodiment, however, the control unit is remote from the assembly. Where the control unit is remote, the sensed parameter, or information related thereto, can be communicated to a data center whereupon diagnostic and/or prognostic analysis is performed based on the sensed parameter information. A corrective action can be controllable initiated in response to the sensed parameter being in, or out side of, a determined range of values.

A regenerative braking system can be coupled to the motor. The regenerative braking system can receive electrical energy generated by the motor when mechanical force is applied thereto. The regenerative braking system can store energy generated in an energy storage system The generated energy can be electrical energy, and the energy storage system can supply boost power in addition to power supplied by a generator so that the generator output is less than the peak power demand of the assembly load, but the combined power is at least as great as the peak power demand of the assembly load. In additional or alternative embodiments, mechanical energy may be stored in the form of compressed gas, hydraulic pressure, a flywheel, and the like.

The controller, disclosed hereinabove, is in operative communication with the motor. In one embodiment, the controller can control torque supplied by the motor to the transmission. The controller can control the motor and, if present, the second motor that is coupled to the transmission, and the control can be such that one of the motors is speed regulated and the other motor is torque regulated.

In one embodiment, the assembly can have an output capacity or capability that is greater than 3000 horsepower as applied to the spool, and the assembly is mountable to a skid, and while mounted to the skid the assembly and skid together have an area footprint that is less than 15 square meters. The assembly can have a total weight is less than 25,000 kilograms. The assembly can be configurable to be shipped through standard intermodal travel without complete disassembly and separate shipping of the assembly components.

In response to thermal management, a cooling system can be supplied and placed in thermal communication with the motor. The regenerative power system can use dynamic breaking to supply electricity to an electric blower (or like device) that is a component of the cooling system. That is, the controller can selectively power the cooling system from a continuous power supply (such as a diesel electric generator), from the dynamic braking, or from an energy storage system. Appropriate sensors, gauges and the like can supply the controller with information that is used to select the power source, when to make the selection, and so forth.

In one embodiment, the planetary transmission includes a compound planetary gearset. This compound planetary gearset can produce different gear ratios depending on which gear is selected as the input, which gear is used as the output, and which gear is held still. For instance, if the input is the sun gear, and the ring gear is held stationary and the output shaft is attached to the planet carrier, there is a first gear ratio. In this case, the planet carrier and planets orbit the sun gear, so instead of the sun gear having to spin, for example, six times for the planet carrier to make it around once, it has to spin seven times. This is because the planet carrier circled the sun gear once in the same direction as it was spinning, subtracting one revolution from the sun gear. So in one instance case, there is a 7:1 reduction.

In a different operating mode, one could hold the sun gear stationary, take the output from the planet carrier and hook the input up to the ring gear (or "annulus"). This would give a much lower gear reduction ratio. Clutches and brake bands can be used to hold different parts of the gearset stationary and change the inputs and outputs. The controller, then, can selectively use the various operating modes in response to external direction or stimulus, or based on set algorithms.

In various aspects, the assembly is suitable for use as a drawworks, crane, anchor hoist, anchor-handling winch, or cable layer. In another aspect, embodiments may be vertically configured to handle a continuous loop of cable, for example via a sheave/pulley. Such embodiments may be useful, e.g., with a ski lift, tram, gondola drive, and the like.

In one embodiment, an assembly includes a spool having an inner surface defining a volume; a motor disposed in the spool volume; and a transmission disposed in the spool volume, and the motor is operable to provide mechanical power to the gearbox such that the transmission can cause the spool to rotate about an axis. The motor can be coaxial with the spool. The transmission also can be coaxial with the spool. Both the motor and the transmission can be simultaneously coaxial and/or collinear with the spool. The torque density (torque per volume) for some embodiments may exceed 2000 kips where the volume is less than about 30 cubic meters.

In various other embodiments, an apparatus can include a spool defining an axis about which the spool is rotatable; a common shaft disposed on the axis; and a motor directly coupled to the common shaft and coaxial with the shaft and the spool. Optionally, the apparatus can include a motor; a transmission coupled to the motor; a brake coupled to the transmission; and a rotatable spool coupled to the transmission, and operable to be rotated thereby. The assembly is entirely devoid of intermediate, universal or flexible couplings disposed between one or more of the motor, transmission, brake and spool. Further, the apparatus can include a motor; a transmission coupled to the motor; and a spool coupled to the transmission that defines an axis and is rotatable about that axis, wherein the motor and transmission are configured to rotate about the axis in conjunction with rotation about the axis by the spool. Also, the apparatus can include a spool and a gearbox coupled to the spool and operable to rotate the spool. The gearbox can include three or more gears that provide relatively symmetrical thrust angles relative to themselves and about perpendicular relative to the spool axis.

An electro-mechanical drive module can be useful as a component of a hoist, winch, or drawworks apparatus. The drive module can include a motor; a transmission coupled to the motor; and a spool coupled to the transmission such that the resulting electro-mechanical drive module satisfies one or more of the following criteria: the electro-mechanical drive module rotates and/or reacts relative to itself, and requires mounting only to a single fixed and/or stationary reference; the electro-mechanical drive module create a single reactionary moment or couple during use; or the transmission fully supports the spool without intervening couplings capable of transferring mechanical energy.

With reference to FIG. 1, an apparatus 100 includes a motor 110, a transmission 120, a spool 130, and a common shaft 140. The spool defines a spool axis 150, and the reference number 160 indicates symmetric gear thrust angles. A brake system 170 couples to a portion of the common shaft 140.

Figure 2:
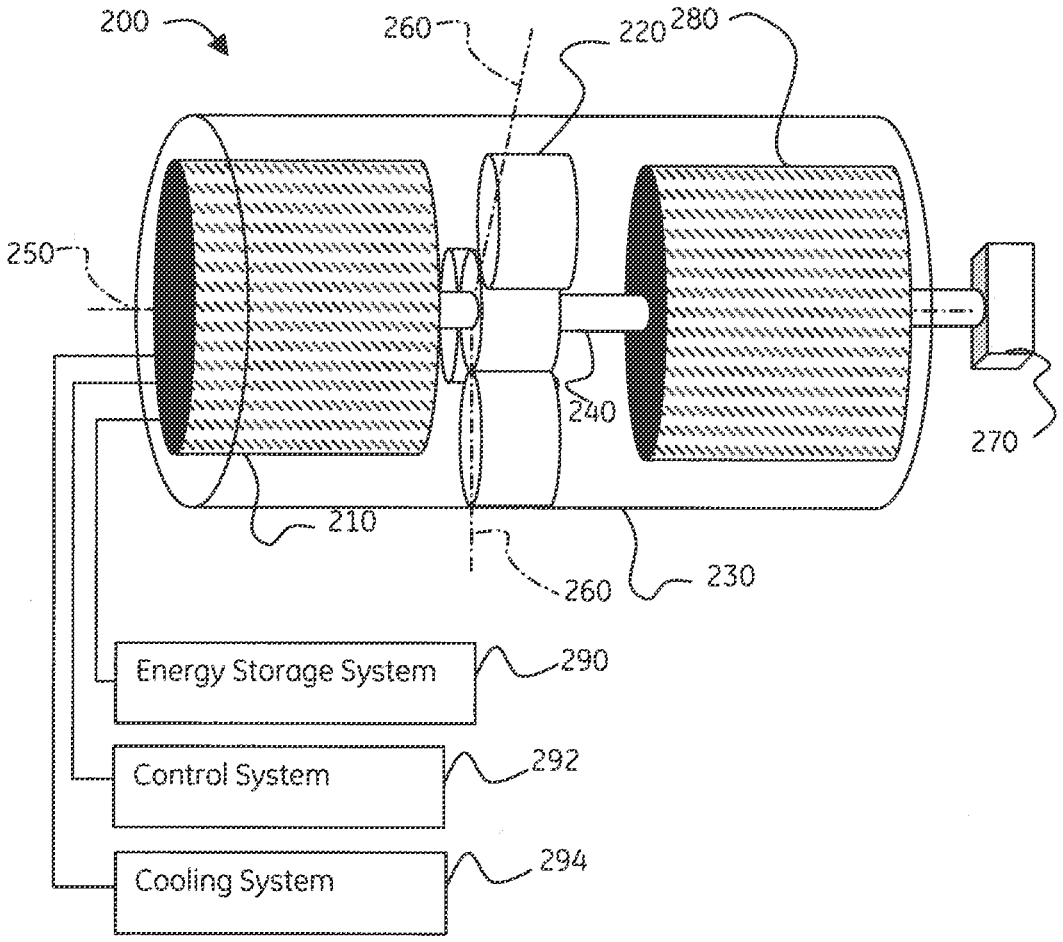
FIG. 2 is a schematic diagram of an assembly that includes one or more embodiments of the invention.

An assembly 200 including an embodiment of the invention is shown in FIG. 2. The assembly includes an internal permanent magnet (IPM) motor 210, a compound planetary gearbox 220, a drum 230, and a segmentable common shaft 240. The drum defines a drum axis 250, and the reference number 260 indicates gear thrust angles perpendicular to the drum axis. A brake system 270 and a second motor 280 are coupled to the common shaft. The IPM motor and the second motor are entirely disposed within a volume defined by an inner surface of the drum. During use, a controller (not shown) signals the motor to activate and convert electrical energy into mechanical energy, which is transferred through the planetary gearbox to a ring gear (not shown) and on through to the drum. The mechanical energy applies torque to rotate the drum around the drum axis. Depending on the state of the assembly during use, the drum rotation may take in, or pay out, a line (not shown) that coils about the outer surface of the drum. Mounting structures (not shown) can support the motors, and can secure or fix the assembly to a skid or to a frame.

With further reference to FIG. 2, an energy storage system 290 is electrically coupled to the motor. The energy storage system can receive electrical energy from the motor when the motor is used for dynamic braking of the rotation of the drum.

The energy storage system reduces the need for a resistor bank with which to dispose of the electricity generated by the dynamic braking. The energy storage system can store the electricity, and can pay the electricity back to the motor to supplement other electricity supply, and thereby to boost (or run entirely) the motor. A control system 292 and a cooling system 294 are shown in communication with the assembly. Each provides the function as defined herein.

Although embodiments are described herein with reference to a drive assembly and apparatus for a hoist, such embodiments are provided for illustration or example purposes, and the invention is not necessarily limited in this regard. In a more general sense, embodiments of the invention relate to an assembly or apparatus, such as for moving a spool, cylinder, or other body.

In the specification and claims, reference will be made to a number of terms have the following meanings. The singular forms "a", an and the include plural referents unless the context clearly dictates otherwise. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Similarly, "free" may be used in combination with a term, and may include an insubstantial number, or trace amounts, while still being considered free of the modified term.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The embodiments described herein are examples of articles, compositions, and methods having elements corresponding to the elements of the invention recited in the claims. This written description may enable those of ordinary skill in the art to make and use embodiments having alternative elements that likewise correspond to the elements of the invention recited in the claims. The scope of the invention thus includes articles, compositions and methods that do not differ from the literal language of the claims, and further includes other articles, compositions and methods with insubstantial differences from the literal language of the claims. While only certain features and embodiments have been illustrated and described herein, many modifications and changes may occur to one of ordinary skill in the relevant art. The appended claims cover all such modifications and changes.

What is claimed is:

1. An assembly for use as a draw works, comprising:

a motor;

a second motor;

a planetary transmission coupled to the motor and the second motor; and a spool coupled to the transmission and having an interior volume for receiving the motor, the second motor and the transmission, and the motor and the second motor are disposed or disposable entirely within the spool;

wherein the motor and the second motor are capable of being operated such that one of the motors is speed controlled, and the other motor is torque controlled; and wherein the motor has a power to weight ratio of greater than 0.182 horsepower per pound (HP/lb).

2. The assembly as defined in claim 1, wherein the motor has a horsepower rating of greater than 1500 horsepower.

3. The assembly as defined in claim 1, wherein the transmission is directly coupled to the motor without additional intervening mechanical couplings or joints.

4. The assembly as defined in claim 1, wherein the transmission is directly coupled to the spool without intervening mechanical couplings or joints.

5. The assembly as defined in claim 1, wherein the transmission has a torque density of greater 100 HP per liter.

6. The assembly as defined in claim 1, wherein the transmission is disposed or disposable entirely within the spool.

7. The assembly as defined in claim 1, further comprising a brake system coupled to the spool.

8. The assembly as defined in claim 7, further comprising a common shaft coupled to the transmission, and the common shaft is coupled to the brake system.

9. The assembly as defined in claim 7, wherein the brake system is a dry brake system.

10. The assembly as defined in claim 9, wherein the dry brake system is a disk brake system.

11. The assembly as defined in claim 7, wherein the brake system is a wet brake system.

12. The assembly as defined in claim 11, wherein the wet brake system is a hydraulic brake system.

13. The assembly as defined in claim 1, further comprising a regenerative braking system coupled to the motor.

14. The assembly as defined in claim 13, wherein the regenerative braking system can receive electrical energy generated by the motor in response to rotation of the spool caused by tension of a line that both is coupled to the spool and that is wound at least partially about the outer surface of the spool.

15. The assembly as defined in claim 13, wherein the regenerative braking system can store energy generated in an energy storage system.

16. The assembly as defined in claim 1, further comprising a controller in operative communication with the motor, wherein the controller is operable to control the motor, and the second motor that is coupled to the transmission, such that one of the motors is speed regulated and the other motor is torque regulated.

17. The assembly as defined in claim 1, wherein the assembly is configured for use as a crane, anchor hoist, anchor handling winch, or cable layer; or is configured for use as a ski-lift, tram, or gondola via drive or control of a loop of cable.

18. An assembly for use as a draw works, comprising:

a spool having an inner surface defining a volume;

a first motor and a second motor disposed in the spool volume;

and a transmission disposed in the spool volume, and the first motor and the second motor are operable to provide mechanical power to the transmission such that the transmission can cause the spool to rotate about an axis;

wherein the first motor and the second motor are capable of being operated such that one of the motors is speed controlled, and the other motor is torque controlled; and wherein a torque density (torque per volume) of the assembly exceeds 2000 kips where the volume is less than about 30 cubic meters.

* * * * *